US009273834B2

(12) United States Patent
Alfier

(10) Patent No.: US 9,273,834 B2
(45) Date of Patent: Mar. 1, 2016

(54) METHOD FOR MOUNTING LIGHT RADIATION SOURCES AND LIGHT SOURCE THEREFOR

(71) Applicant: OSRAM GmbH, Munich (DE)

(72) Inventor: Alberto Alfier, Vedelago (IT)

(73) Assignee: OSRAM GmbH, Munich (DE)

( * ) Notice: Subject to any disclaimer, the term of this patent is extended or adjusted under 35 U.S.C. 154(b) by 41 days.

(21) Appl. No.: 14/182,307

(22) Filed: Feb. 18, 2014

(65) Prior Publication Data

US 2014/0240986 A1 Aug. 28, 2014

(30) Foreign Application Priority Data

Feb. 25, 2013 (IT) ..... TO2013A0152

(51) Int. Cl.
*F21K 99/00* (2010.01)
*F21Y 105/00* (2006.01)
*F21Y 113/00* (2006.01)

(52) U.S. Cl.
CPC ... *F21K 9/50* (2013.01); *F21K 9/90* (2013.01); *F21Y 2105/003* (2013.01); *F21Y 2113/005* (2013.01); *Y10T 29/4913* (2015.01)

(58) Field of Classification Search
CPC ..... F21K 9/50; F21K 9/90; H01L 33/005; H01L 33/56; H01L 33/62; H01L 33/483
See application file for complete search history.

(56) References Cited

U.S. PATENT DOCUMENTS

2006/0061539 A1* 3/2006 Song et al. ..... 345/102
2013/0234176 A1 9/2013 Wilm

FOREIGN PATENT DOCUMENTS

EP 1750486 A1 2/2007
JP 2008277174 A 11/2008
WO 2008069204 A1 6/2008
WO 2012034827 A1 3/2012

OTHER PUBLICATIONS

English abstract of JP 2008277174 dated Nov. 13, 2008.
Search Report issued in the corresponding Italian application No. TO20130152 dated Nov. 19, 2013.

* cited by examiner

*Primary Examiner* — Kyoung Lee
(74) *Attorney, Agent, or Firm* — Viering, Jentschura & Partner mbB

(57) ABSTRACT

A method of placing on a mounting substrate light radiation sources arranged in successive sequences wherein each sequence includes light radiation sources from different bins having respective light emission characteristics and wherein the sequential order of recurrence of the light radiation sources of the various bins is repeated over the sequences, may include placing the light radiation sources on the mounting substrate in at least two juxtaposed rows, wherein each row includes light radiation sources arranged in a zigzag pattern to produce an chessboard-like array of light radiation sources.

18 Claims, 2 Drawing Sheets

METHOD FOR MOUNTING LIGHT RADIATION SOURCES AND LIGHT SOURCE THEREFOR

RELATED APPLICATION

This application claims priority to Italian Patent Application Serial No. TO2013A000152, which was filed Feb. 25, 2013, and is incorporated herein by reference in its entirety.

TECHNICAL FIELD

The disclosure relates to lighting sources.

Various embodiments may relate to solid state lighting sources (known as solid state lighting or SSL), using, for example, LED light radiation sources.

BACKGROUND

In order to provide solid state lighting sources it is possible to place on a substrate an array or "cluster" of radiation sources (of the LED type for example), using a combination of light radiation sources having different emission characteristics (in terms of the wavelength and/or intensity of the emitted flux, for example): this combination provides compensation for the variations of characteristics that may arise in the process of manufacturing the sources.

This procedure yields savings in respect of the process for manufacturers of light sources, and also improves the emission performance without appreciably increasing the fixed production costs, whereas, if a specific selection were made in terms of emission wavelength (color) and flux (light intensity) in the course of production, this could entail a rise of 10% to 20% in production costs.

The use of a combination of light radiation sources to provide this compensatory effect may make additional demands in terms of logistics and storage. However, it is possible to use the technique known as "binning", in which the light radiation sources are arranged in distinct batches (called "bins") on the basis of what are known as binning classes, defined according to the emission characteristics (e.g. direct operating voltage; emission wavelength and characteristics, or "color"; and flux or light intensity). An example of a solution for using light radiation sources belonging to different binning classes is described in EP 1 750 486 E1.

In various solutions, light radiation sources (referred to below as LED sources for the sake of simplicity) contained in a given bin may be placed on a reel. The sources can then be picked up from the reel, for example by using a "pick and place" machine, which places the sources on a substrate to form an array or cluster, thus providing the effect of combination by application of the principles of colorimetric theory so as to achieve the desired effects in terms of color, flux and/or supply voltage.

In various solutions, lighting devices ("light engines") can be produced by using LEDs arranged in three to four bins, for example, these quantities being chosen so as to avoid excessive complexity and cost in respect of the production cycle and the logistical aspects associated with the use of binning. For the purposes of production, it is possible to load each pick and place machine with reels, each of which corresponds to a given bin.

Assuming, by way of example, that N bins are used to produce lighting devices each comprising a number of LEDs equal to M, then in order to provide a production batch of J devices with K LEDs per reel, $(M \times J)/(K \times N)$ reels must be managed for each bin. In numerical terms, if 600 lighting modules or devices are to be produced, each comprising 32 LEDs, and 600 LEDs are available on each reel, with the LEDs arranged in four bins, then 8 reels will be used for each of the four bins. A set of reels of this type is called a "kit" of LEDs.

In various solutions it may be necessary to keep the various reels forming the LED kit in store, ensuring that each individual reel in the kit is identified and locatable for the purposes of production logistics, so that a given bin can be located in a given position of the cluster, using a dedicated program for controlling the pick and place machine for each bin.

In WO 2012/034827 A1 it is proposed to place light radiation sources (such as LEDs) taken from n different bins in sequence on the same reel, repeating the sequence of these LEDs so as to obtain the desired characteristics in the lighting device by the use of combination as described above.

This document (see for example FIG. 2 of WO 2012/034827 A1) therefore proposes the production of a packaging unit (e.g. a reel) in which the light radiation sources are arranged in successive sequences in which each sequence includes light radiation sources taken from different bins having respective light emission characteristics, the sequential order of appearance of the different bins from which the various light radiation sources are taken being repeated in an identical manner (e.g. A, B, C, D, . . . ) in the successive sequences throughout.

Using the terminology of the document in question, the light radiation sources (LEDs) are therefore arranged in the packaging unit (e.g. a reel) in such a way that the packaging unit includes a plurality of successive sequences including, in each case, a plurality of light radiation sources, in which each sequence has, respectively, a light source taken from each of the ranges of color characteristics (or "bins"), and the light radiation sources in the different bins within the sequence are, respectively, arranged in the same order in all the sequences.

In practice, if the various light sources are identified according to the different bins to which they belong, by letters such as A, B, C and D, the sequence of distribution of the light radiation sources in the packaging unit (a reel, for example) can be represented thus: A B C D A B C D A B C D A B C D A B C D A B C D, and so on, as shown by way of example in FIG. 2 of WO 2012/034827 A1).

For mounting, the prior document in question specifies (see FIG. 3 of WO 2012/034827 A1) that a cluster of the matrix type is formed from the sequence A, B, C, D, A, B, C, D, . . . , this cluster being arranged in rows and columns in a sequence that can be interpreted as a sequence ordered in rows with a return "to the start" at the end of each row, thus:

| | | |
|---|---|---|
| A | B | C |
| D | A | B |
| C | D | A |
| B | C | D |

In some cases at least, this solution is vulnerable to a loss of a single radiation source, due for example to the "skipping" of one of the light radiation sources in the pick-up sequence during the mounting on the substrate carried out by the pick and place machine, as a result of which the overall effect of the combination is degraded.

A generally similar problem may also arise in a cluster mounted in a regular way (in other words, without "skipping" any radiation source), if one of the radiation sources in the cluster is subject to a fault, regardless of whether the fault is "soft" (where the source emits at a lower level of luminosity than expected, although it does not stop emitting altogether) or "hard" (where the light radiation source stops emitting altogether).

SUMMARY

Various embodiments overcome the aforementioned drawbacks.

According to various embodiments, this object is achieved by means of a method having the characteristics claimed in the claims below.

Various embodiments may also relate to a corresponding lighting device.

Various embodiments may use a packaging unit such as a reel combined with a mounting apparatus such as a pick and place machine.

In various embodiments, the mounting apparatus may follow a given sequence for positioning the light radiation sources on a substrate, thus producing a cluster in which the light radiation sources (of the LED type for example) are placed closely together (for example, with a spacing of less than 1.5 times the smaller dimension of the LED package).

In various embodiments, a bin sequence of light radiation sources in a unit or reel can be combined with a bin sequence taken from another reel or from within the same reel.

In various embodiments, the loss of a light radiation source during the mounting process (performed by a pick and place machine, for example) has a smaller effect on the emission characteristics of the cluster, making it possible to avoid skipping a number of successive sources equal to n−1, where n is the number of sources included in a sequence.

BRIEF DESCRIPTION OF THE DRAWINGS

In the drawings, like reference characters generally refer to the same parts throughout the different views. The drawings are not necessarily to scale, emphasis instead generally being replaced upon illustrating the principles of the disclosure. In the following description, various embodiments of the disclosure are described with reference to the following drawings, in which.

DETAILED DESCRIPTION

The following description illustrates various specific details intended to provide a deeper understanding of various exemplary embodiments. The embodiments may be produced without one or more of the specific details, or with other methods, components, materials, etc. In other cases, known structures, materials or operations are not shown or described in detail, in order to avoid obscuring various aspects of the embodiments. The reference to "an embodiment" in this description is intended to indicate that a particular configuration, structure or characteristic described in relation to the embodiment is included in at least one embodiment. Therefore, phrases such as "in an embodiment", which may be present in various parts of this description, do not necessarily refer to the same embodiment. Furthermore, specific formations, structures or characteristics may be combined in any suitable way in one or more embodiments.

The references used herein are provided purely for the convenience of the reader, and therefore do not define the scope of protection or the extent of the embodiments.

Figure 1:
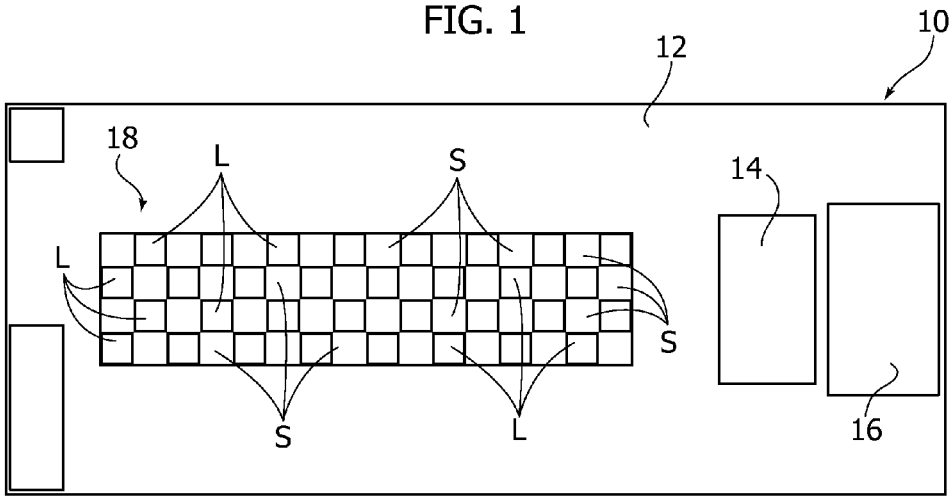
FIG. 1 is a schematic view of a lighting device according to some embodiments.

In FIG. 1, the reference 10 indicates the whole of a solid state lighting device or module (solid state lighting, or SSL) which uses LED sources as light radiation sources.

In the illustrated exemplary embodiment, the device 10 comprises a substrate 12 (which is, for example, of rectangular shape and/or capable of being made, for example, by a technology similar to that used for printed circuit boards (PCBs)), on which is mounted an array or cluster 18 of light radiation sources L, together with any necessary electronic driving and control circuitry 14 with an associated connector 16.

In various embodiments, the light radiation sources L may be LED sources and/or may be ordered in an array in a generally chessboard-like arrangement).

In various embodiments, the light radiation sources L (referred to below as LEDs for the sake of simplicity) may be quadrangular in shape (square or rectangular, for example), being separated by square separating spaces S.

In various embodiments, the LEDs L may have a quadrilateral footprint having a side dimension (or a minor side dimension) of about 3 mm, for example in the form of a square footprint measuring 3×3 mm.

In various embodiments, the separating spaces S may have a homologous shape, for example a square shape with a side dimension of 3.25 mm.

In various embodiments, the quadrilateral footprint of the LEDs L therefore has a (first) side length, identified for example as the minor side length, while the square spaces S have a (second) side length which is less than 1.5 times the first side length.

Figure 2:
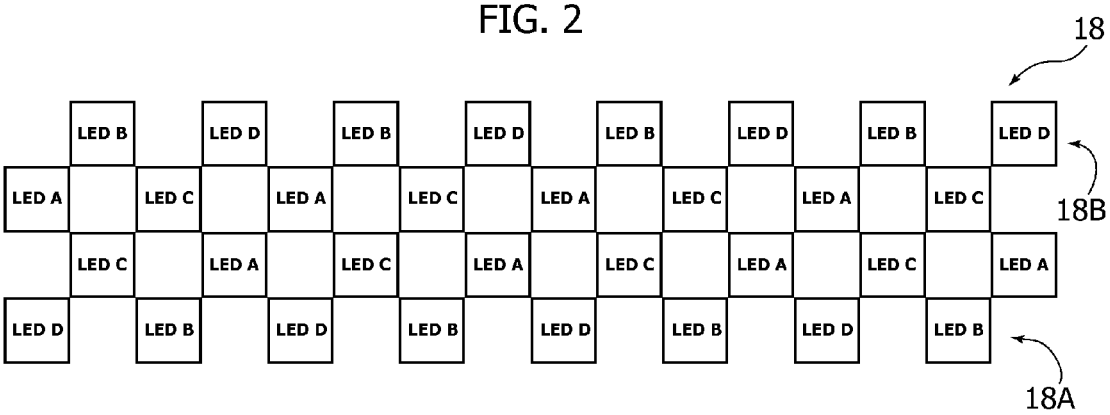
FIG. 2 shows a possible distribution of light radiation sources according to some embodiments.
Figure 3:
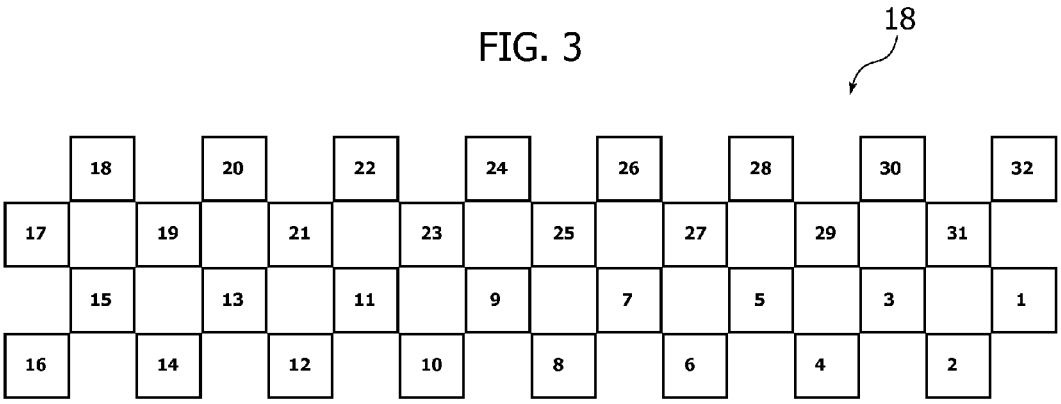
FIG. 3 shows a possible corresponding mounting sequence.

In the embodiments described herein by way of example, the array or cluster 18 may comprise thirty-two LEDs ordered in two lines or rows 18A and 18B, each comprising sixteen LEDs L mounted on the substrate 10 in a zigzag pattern as shown by way of example in FIGS. 2 and 3.

These figures show by way of example, with reference to the example of the cluster 18 in FIG. 1, respectively:

- the distribution of the LEDs identified as LEDs of four different types, LED A, LED B, LED C and LED D respectively, on the basis of their inclusion in four different bins (or binning classes) A, B, C and D, defined on the basis of emission characteristics such as the emission wavelength (or, more precisely, the range of wavelengths), the emitted flux, and/or the direct power supply voltage, and
- the sequence followed in the mounting on the substrate 10, by means of a pick and place machine for example, which picks up the LEDs to be mounted in sequence from a packaging unit (such as the reel shown by way of example in FIG. 2 of the document WO 2012/034827 A1), where the LEDs of the four bins or binning classes described above by way of example are arranged in the order . . . A, B, C, D, A, B, C, D, . . . , in other words in successive sequences in which each sequence comprises light radiation sources from different bins having respective light emission characteristics, and in which the sequential order of recurrence of the light radiation sources according to the different bins is repeated (in an identical manner) in the sequences, that is to say A, B, C, D, followed by A, B, C, D, followed again by A, B, C, D, and so on.

FIG. 3 refers to a possible mounting sequence in the order represented by numbers increasing from 1 to 32 as shown in the figure, in other words on the basis of a sequence that can be represented by the following table.

| Type of LED (FIG. 2) | Mounting position (FIG. 3) |
|---|---|
| LED A | 1 |
| LED B | 2 |
| LED C | 3 |
| LED D | 4 |
| LED A | 5 |
| LED B | 6 |
| LED C | 7 |
| LED D | 8 |
| LED A | 9 |
| LED B | 10 |
| LED C | 11 |
| LED D | 12 |
| LED A | 13 |
| LED B | 14 |
| LED C | 15 |
| LED D | 16 |
| LED A | 17 |
| LED B | 18 |
| LED C | 19 |
| LED D | 20 |
| LED A | 21 |
| LED B | 22 |
| LED C | 23 |
| LED D | 24 |
| LED A | 25 |
| LED B | 26 |
| LED C | 27 |
| LED D | 28 |
| LED A | 29 |
| LED B | 30 |
| LED C | 31 |
| LED D | 32 |

By examining FIGS. 2 and 3 together it can be clearly seen that, in various embodiments, the mounting sequence may provide for the arrangement of the light radiation sources LED A, LED B, LED C, LED D, belonging to the bins or binning classes A, B, C, D as taken from a reel of the type described by way of example in WO 2012/034827 A1, in such a way that the light radiation sources in question are arranged in the cluster in at least two juxtaposed lines or rows (indicated respectively by 18A and 18B in FIG. 2), with each line or row comprising light radiation sources arranged in a zigzag configuration such that it creates the chessboard-like distribution of the cluster 18.

In particular (see also the mounting sequence shown by way of example in FIG. 3), each of the lines or rows 18A, 18B (which are two in number in the exemplary embodiments described herein, although the number could be greater) comprises light radiation sources arranged in successive sequences in which each sequence comprises light radiation sources (LED A, LED B, LED C, LED D) from different bins (A, B, C and D), having respective light emission characteristics, and in which the sequential order of recurrence of the sources as a function of their bin of origin is repeated in the sequence.

For example, in the exemplary embodiment shown in FIGS. 2 and 3, if we start by examining the zigzag line 18A shown in the lower part of FIG. 2, a first sequence LED A, LED B, LED C, LED D (in other words four types of LED taken from four bins A, B, C, D respectively) can be found in the lower right-hand area, these LEDs being taken in sequence from their reels of origin by the pick and place machine, and being placed in the mounting positions indicated by 1, 2, 3 and 4 respectively in the lower right-hand area of FIG. 3.

A comparative examination of FIGS. 2 and 3 will make it clear that, in the lower line or row 18A (which is assumed to be filled by proceeding from right to left), the sequence of four LEDs described above by way of example is followed by a similar sequence of another four LEDs (LED A, LED B, LED C and LED D), also taken in sequence from the reel by the pick and place machine, which arranges them on the substrate 10 in the mounting positions indicated by 5, 6, 7 and 8 in FIG. 3.

The mounting principle described above by way of example is repeated twice more in the lower line 18A until the specified number of sixteen LEDs is complete, and is then reproduced in the upper line 18B, which is "filled" by the pick and place machine according to the numerical sequence shown in the upper part of FIG. 3, in other words by "filling" the positions from left to right, starting from position 17 (on the left in FIG. 3) and successive positions, after the filling of the lower line 18A has been completed at the position indicated by 16: in this mode of arrangement (which may be called a "to and fro" mode), the last light radiation sources placed in a row or line (for example the LEDs mounted at positions 13, 14, 15 and 16 of the lower line 18A) are placed in the proximity of the first light radiation sources of the adjacent or juxtaposed line (in other words, positions 17, 18, 19 and 20 of line 18B in the example under discussion).

On the other hand, it will be appreciated that the principle stated by way of example with reference to the left-hand end of the cluster 18 as illustrated in FIGS. 2 and 3 is also reproduced identically at the opposite end; here, the last light radiation sources positioned in the upper line 18B (in other words, those corresponding to the positions indicated by 29, 30, 31 and 32 of FIG. 3) are located in the proximity of the first light radiation sources located in the adjacent or juxtaposed line (in other words, positions 1, 2, 3 and 4).

By examining FIGS. 2 and 3 it can also be seen that, in various embodiments, each zigzag row or line (in other words, row 18A and row 18B of the cluster 18 described herein by way of example) comprises a number of light radiation sources which is equal to or an integer multiple of the number of light radiation sources included in each packaging sequence in the reel.

In particular, in the non-limiting example considered herein, the sequence in question comprises a number n equal to four, in other words four LEDs (from four bins A, B, C and D), with each of the rows 18A, 18B comprising sixteen LEDs, in other words a number of LEDs equal to four times the number n of LEDs included in the sequence.

In the same way, in various embodiments, the number of light radiation sources or LEDs in each line or row (a number equal to sixteen in the examples considered herein) is equal to at least twice the number n of light radiation sources included in the sequence taken from the reel (n=4 in the example A, B, C, D considered herein).

In the exemplary embodiments considered herein, the zigzag rows or lines juxtaposed to form the chessboard-like cluster are two in number (18A and 18B respectively). In various embodiments, the cluster could include, for example, four of these lines or rows, each including, for example, sixteen LEDs, with the cluster 18 containing a total of sixty-four LEDs or light radiation sources.

The various characteristics intrinsic in the dimensions, arrangements and mounting sequence of the light radiation sources L on the substrate 10 are generally applicable regardless of the number of zigzag rows or lines included in the chessboard pattern and/or the number of light radiation sources included in each row or line.

Figure 4:
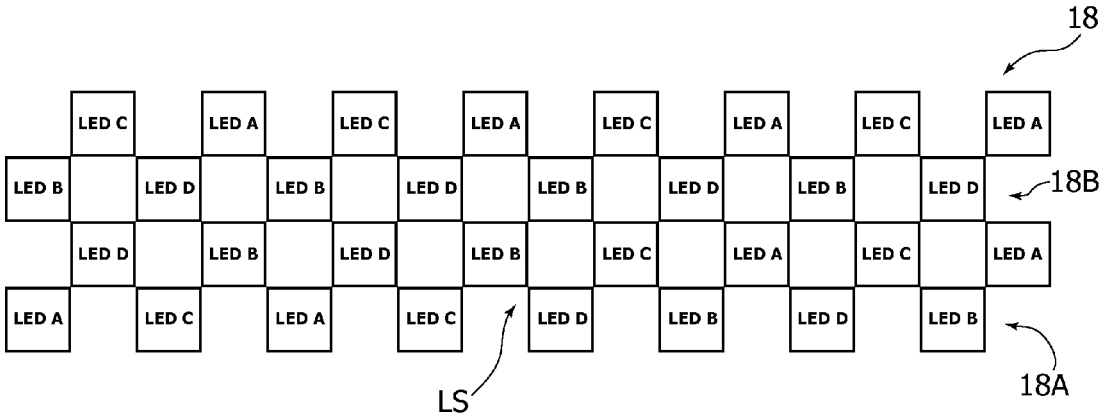
FIG. 4 is a schematic illustration of the possible effect of a loss of a light radiation source.

FIG. 4 shows by way of example the possible effect on the mounting arrangement of the light radiation sources on the substrate 12 of the fact that one of these sources has been "lost", for example while the sources were being picked up by the pick and place machine.

If FIG. 4 is compared with FIG. 2, it will be appreciated that FIG. 4 refers to the case in which the first LED (in other words an LED A belonging to the bin or binning class A) of the third sequence taken from the reel and intended for mounting in the position indicated by 9 in FIG. 3 has been lost (in the position indicated as LS), and consequently an LED of the LED B type, in other words an LED belonging to bin B, has been mounted in its place The mounting sequence remains unchanged in other respects as regards the retention of the sequential order of origin from the different bins (in other words, . . . B, C, D, A, B, C, . . . and so on), thus creating, on completion of the cluster 18, a sequence as shown in FIG. 4. This sequence is therefore partly staggered by one position relative to that shown in FIG. 2: indeed, it can be seen that the mounting position indicated by 32 in FIG. 3 is not occupied by an LED D (in other words an LED belonging to the bin or binning class D), but is occupied by an LED A (in other words by an LED belonging to bin A, that is to say an LED homologous to that which was lost during mounting in the position indicated by 9 in FIG. 3).

In various embodiments, the accidental "loss" of one of the light radiation sources during the mounting of a source LS, for example in the conditions described by way of example, may cause the emission performance (compared with a cluster as shown by way of example in the figures, comprising eight sequences of four light radiation sources each) to vary from the expected emission performance by 1/32, in other words by 3% relative to the expected emission characteristics (particularly the flux and chromatic characteristics).

Most importantly, in the mounting sequence illustrated herein, position 9 of FIG. 3 may be described as being "recovered" at the end of the sequence (in position 32): the overall effect on the chromatic or color temperature (CCT) characteristics and/or emission flux is consequently negligible.

This is supported by the fact that, in various embodiments, the distribution of the sources in the binning classes selected within a range of given width (e.g. +/−10%) relative to the objective values as regards both the flux and the color may in reality be less wide, so that the deviation from the characteristics of flux and objective color is in practice less than 1%.

Figure 5:
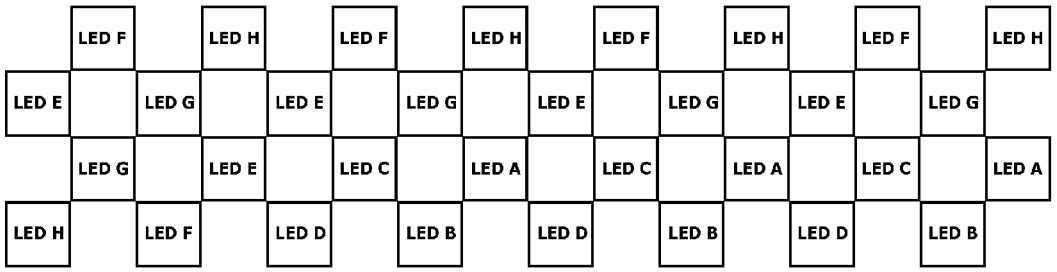
FIG. 5 illustrates some embodiments.

FIG. 5 shows by way of example, in ways similar to those used in the preceding figures and particularly with reference to a mounting sequence as shown by way of example in FIG. 3, the possibility of using, in what may be described as an interleaved mode, sequences (again having a length n=4, for example) of light radiation sources related to a greater number of bins or binning classes. For example, provision may be made to interleave the sequences LED A, LED B, LED C and LED D using LEDs from four different "bins" with sequences LED E, LED F, LED G and LED H, again of four light radiation sources, taken from four bins E, F, G, H.

Clearly, in various embodiments, the interleaved sequences may have different lengths (periodicities). For example, instead of having interleaved sequences of four elements, for example:

LED A, LED B, LED C, LED D, LED E, LED F, LED G, LED H, LED A, LED B, LED C, LED D, LED E, LED F, LED G, LED H, LED A and so on, it would be possible to have interleaved sequences of four and three elements, for example:

LED A, LED B, LED C, LED D, LED E, LED F, LED G, LED A, LED B, LED C, LED D, LED E, LED F, LED G, LED A, and so on.

The remarks made above concerning the possible effect of the "loss" of a light radiation source during mounting are equally applicable to the exemplary embodiment of FIG. 5.

It will be appreciated that, since a plurality of sequences interleaved with each other can be used (possibly according to a more complex scheme than the simple alternation of A, B, C, D, and E, F, G, H described herein by way of example), it is possible to use more refined principles of combination of the binning classes than those described herein by way of example.

Various embodiments therefore make it possible to use the method of "champing" the light radiation sources described by way of example in the document WO 2012/034827 A1 according to criteria of high flexibility, thus minimizing (and virtually eliminating) the effects of the possible loss of a radiation source and maximizing the effect of combining the LEDs from different binning classes.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A method of placing on a mounting substrate light radiation sources arranged in successive sequences wherein each sequence includes light radiation sources from different bins having respective light emission characteristics and wherein the sequential order of recurrence of the light radiation sources of the various bins is repeated over the sequences, the method comprising placing the light radiation sources on the mounting substrate in at least two juxtaposed rows, wherein each row includes light radiation sources arranged in a zigzag pattern to produce a chessboard-like array of light radiation sources.

2. The method as claimed in claim 1, wherein said sequences include a set of a number n of the light radiation sources from different bins and each said row includes a number of the light radiation sources which is equal to or an integer multiple of said number n.

3. The method as claimed in claim 1, wherein said sequences include a set of a number n of the light radiation sources from different bins and each said row includes a number of the light radiation sources which is equal to at least twice said number n.

4. The method as claimed in claim 1, wherein said successive sequences include at least two types of sequence interleaved with one another.

5. The method as claimed in claim 1, wherein said chessboard-like array is formed from two juxtaposed rows of light radiation sources.

6. The method as claimed in claim 1, further comprising placing on the mounting substrate said juxtaposed rows of light radiation sources, with the light radiation sources placed last in a row located in the proximity of the light radiation sources placed first in a juxtaposed row.

7. The method as claimed in claim 1, wherein the light radiation sources in said array have quadrilateral footprints having a first side length and are separated by square spaces having a second side length which is less than 1.5 times said first side length.

8. The method as claimed in claim 7, wherein the footprints of the light radiation sources in said array have a major side length and a minor side length and wherein said first side length is said minor side length.

9. A lighting device including an array of light radiation sources mounted on a substrate, wherein:

the array is a chessboard-like array including at least two juxtaposed rows of light radiation sources arranged in each row in a zigzag pattern, and each row of the light radiation sources arranged in a zigzag pattern includes sources in successive sequences wherein each sequence includes the light radiation sources from different bins having respective light emission characteristics, wherein the sequential order of recurrence of the light radiation sources of the various bins is repeated over the sequences.

10. A method for placing light radiation sources on a mounting substrate comprising:

providing a packaging unit having a plurality of light radiation sources arranged in a plurality of successive sequences of at least one emission characteristic, the successive sequences repeating as to said at least one emission characteristic;

picking the light radiation sources sequentially from the packaging unit; and placing the light radiation sources sequentially on the mounting substrate in at least two horizontal rows;

wherein each row has a vertically alternating zigzag pattern, and wherein the rows are arranged such that the zigzag pattern of each row is juxtaposed relative to the zigzag pattern of an adjacent row to produce a chessboard-like array of light radiation sources on the mounting substrate.

11. The method of claim 10 wherein each of said successive sequences includes light radiation sources from different bins having respective light emission characteristics.

12. The method of claim of claim 11 wherein said sequences include a set of a number n of the light radiation sources from different bins and each said row includes a number of the light radiation sources which is equal to or an integer multiple of said number n.

13. The method as claimed in claim 11, wherein said sequences include a set of a number n of the light radiation sources from different bins and each said row includes a number of the light radiation sources which is equal to at least twice said number n.

14. The method as claimed in claim 11, wherein said successive sequences include at least two types of sequence interleaved with one another.

15. The method as claimed in claim 11, wherein said chessboard-like array is formed from two juxtaposed rows of light radiation sources.

16. The method as claimed in claim 11, further comprising placing on the mounting substrate said juxtaposed rows of light radiation sources, with the light radiation sources placed last in a row located in the proximity of the light radiation sources placed first in a juxtaposed row.

17. The method as claimed in claim 11, wherein the light radiation sources in said array have quadrilateral footprints having a first side length and are separated by square spaces having a second side length which is less than 1.5 times said first side length.

18. The method as claimed in claim 17, wherein the footprints of the light radiation sources in said array have a major side length and a minor side length and wherein said first side length is said minor side length.

* * * * *